US005193294A

United States Patent [19]

Pozzobon et al.

[11] Patent Number: 5,193,294

[45] Date of Patent: Mar. 16, 1993

[54] SKI BOOT WITH QUARTERS HAVING MULTIPLE SECTIONS

[75] Inventors: Alessandro Pozzobon, Paderno di Ponzano Veneto; Giancarlo Foscaro, Treviso; Gianpaola Marongiu, Rome, all of Italy

[73] Assignee: Nordica S.p.A., Montebelluna, Italy

[21] Appl. No.: 685,315

[22] Filed: Apr. 15, 1991

[30] Foreign Application Priority Data

May 4, 1990 [IT] Italy ..... 82562 A/90
May 4, 1990 [IT] Italy ..... 82563 A/90

[51] Int. Cl.[5] ..... A43B 5/04
[52] U.S. Cl. ..... 36/120; 36/117
[58] Field of Search ..... 36/117-121, 36/109

[56] References Cited

U.S. PATENT DOCUMENTS

| | | | |
|---|---|---|---|
| 3,732,635 | 5/1973 | Marker | 36/120 |
| 4,258,482 | 3/1981 | Salomon | 36/121 |
| 4,561,196 | 12/1985 | Petrini et al. | 36/118 |
| 4,653,205 | 3/1987 | Koch | 36/117 |
| 4,958,448 | 9/1990 | Wenzel | 36/120 |
| 5,054,215 | 10/1991 | Tonel et al. | 36/117 |

*Primary Examiner*—Steven N. Meyers
*Assistant Examiner*—Thomas P. Hilliard
*Attorney, Agent, or Firm*—Guido Modiano; Albert Josif

[57] ABSTRACT

A ski boot including at least one quarter and a rigid or overlapping-flap shell. The quarter is constituted by at least two independent strip elements which are associated with one another and/or with the shell in an oscillating manner. The boot allows the quarter to adapt to the anatomical shape of the leg and to optizime its own movement with respect to the leg natural movement, following the leg during the flexion and extension steps.

6 Claims, 5 Drawing Sheets

SKI BOOT WITH QUARTERS HAVING MULTIPLE SECTIONS

BACKGROUND OF THE INVENTION

The invention relates to a ski boot.

The problem of being able to adjust the angular position of the quarters with respect to the resting plane of the sole is currently strongly felt in the field: in known ski boots, this variation is obtained for example by deforming the quarters, with consequent problems due to fatigue of the materials or to permanent deformations thereof.

In known ski boots of the central/rear-entry type, which as such have a shell with overlapping flaps and with separate front and rear quarters, there is the problem due to the fact that the transverse translatory motion of the front quarter, in direct contact with the shell, for the adjustment of the angular position with respect to the sole, creates empty spaces in the region at which the two components overlap one another.

This situation causes a variation in the interference characteristics and therefore in the flexibility of the boot.

It has furthermore been observed that during flexing, since the quarters are mutually secured and articulated at the same point to the shell, their degree of mutual securing is altered.

As a partial solution to these disadvantages, this same applicant filed U.S. Pat. No. 4,575,955 granted on Mar. 18, 1986, disclosing a boot having a front quarter which has a first part which predominantly affects the lateral regions of a skier's leg and is pivoted to the shell, and a second part which predominantly affects the front region of the skier's leg; said second part can be partially superimposed on the first part and is articulated thereto so as to allow a different degree of inclination with respect to the shell in the direction of the tip thereof.

Though this solution is undoubtedly valid, it has the disadvantage of maintaining considerable lateral rigidity as regards adaptation to the anatomy of the leg.

The respective positions of the first and second parts of the quarter in fact cannot be varied within a wide radius, since they must conform to the curve of the foot instep imposed by the first part of the quarter.

It has furthermore been observed that known boots have a considerable lateral rigidity which prevents their use in combination with an implement known as "snowboard".

SUMMARY OF THE INVENTION

The aim of the present invention is therefore to eliminate the disadvantages described above in known types by providing a boot which adapts, during the practice of sports, to the changing needs of the skier which are due to the various positions assumed by the legs, and therefore for front, rear and lateral movements of said legs.

Within the scope of the above described aim, an important object is to provide a boot the quarters whereof adapt to the specific anatomical shapes of the leg, ensuring optimum embracing thereof and adaptation thereto.

Another important object is to provide a boot which can be used for "snowboarding".

Not least object is to provide a boot which is safe and reliable in use.

This aim, these objects and others which will become apparent hereinafter are achieved by a ski boot, composed of at least one quarter and by a shell, characterized in that said at least one quarter is composed of at least two independent strip elements which are associated with one another and with said shell in an oscillating manner.

Advantageously, said at least two or more band-like elements can be associated with one another and/or with said shell by means of at least one bar.

Conveniently, the interconnection between said two or more band-like elements occurs at the lateral ends, with motion along two approximately orthogonal axes.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
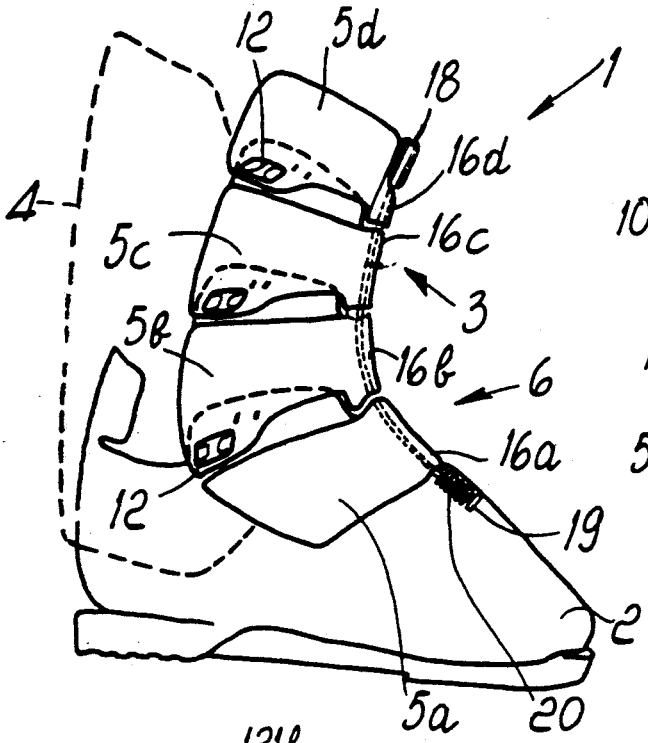
FIG. 1 is a side view of a first embodiment for the front quarter of a boot.
Figure 2:
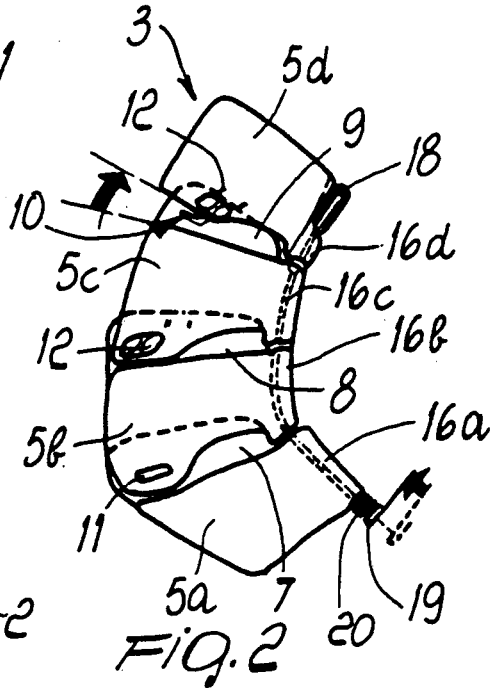
FIG. 2 is a view, similar to the preceding one, of the front quarter, illustrating some adjustments.
Figure 4:
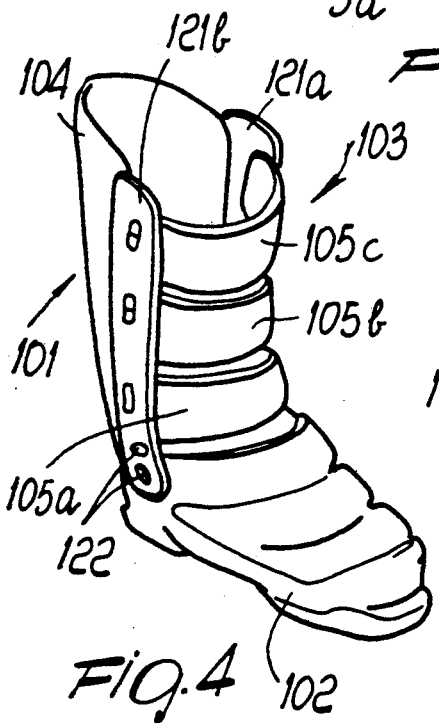
FIG. 4 is a perspective side view of a second embodiment of the boot.
Figure 3:
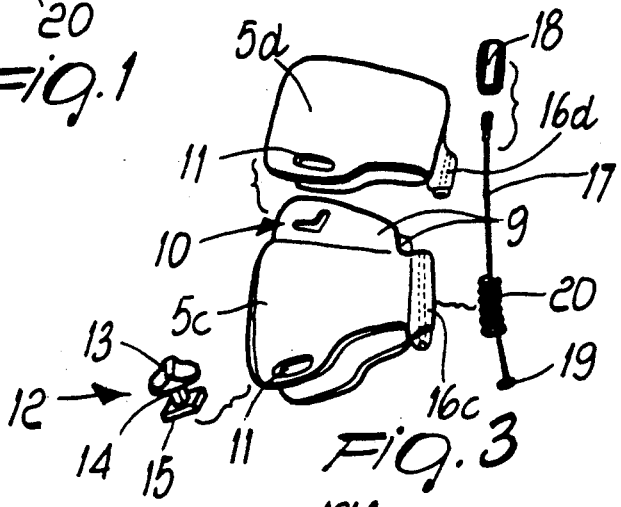
FIG. 3 is an exploded view of two of the band-like elements which constitute the front quarter.

With reference to the above figures, the ski boot, generally indicated by the reference numeral 1, is constituted, in its first embodiment, by a shell 2 with which a front quarter 3 and a rear quarter 4 are associated.

The front quarter 3 is constituted by four strip elements, indicated by the numerals 5*a*, 5*b*, 5*c* and 5*d*.

Each of said strip elements embraces the front region of the skier's leg, and said elements are mutually independent, in that the interconnection between them allows each to perform an oscillating motion regardless of the position of an adjacent strip element.

The strip element 5a is arranged at the foot instep region 6 and has, in the direction of the overlying strip element which is adjacent thereto, a pair of first tabs 7 which protrude at the lateral regions and are slightly thinner, so as to constitute a guide for the sliding of the overlying strip element.

The strip elements 5b and 5c also have, at the region adjacent to the overlying strip element, second tabs 8 and third tabs 9 respectively.

Each of the strip elements can move independently with respect to the others by virtue of the presence of adapted openings 10 at the lateral ends of the first, second and third tabs; advantageously, said openings 10 have an L-shaped configuration, with their wings directed toward the rear quarter 4 and the overlying strip element.

Adapted slots 11 are defined, on the strip elements 5b, 5c and 5d respectively, at the openings 10, which are thus present in the strip elements 5a, 5b and 5c; said slots 11 are arranged approximately at the same axis as the wing of said openings directed toward the rear quarter 4.

The coupling between two adjacent strip elements occurs by interposing, at the openings 10 and at the slots 11, a slider 12 which has a head 13 which can be accessed by the skier and a stem 14 provided with an abutment 15 which can slide in said openings.

Alternatively, the various elements can be fastened together, in a simplified manner, by means of rivets which are inserted in appropriate curved holes on the strip elements and can slide within substantially vertical or curved openings defined on the tabs of the strip elements.

Advantageously, the interconnection between the strip elements can also occur along a median axis which is longitudinal thereto, by providing, at said axis, adapted hollow pivots 16a, 16b, 16c and 16d which can be mutually associated temporarily with freedom to move in all directions with respect to one another, by means of an adapted flexible element such as a cable 17.

Advantageously, said cable has, at one end, a knob 18 which is externally knurled for a better grip by the skier's hand and protrudes beyond the pivot 16d and has, at the other end, a rivet 19 which interacts with an adapted spring 20 the function whereof is to adjust the elastic contrast between the various strip elements so as to allow a more or less easy oscillation therebetween.

The use of the boot is in fact as follows: by virtue of the presence of the openings 10, of the slots 11 and of the sliders 12, the skier can select the preferred position of each of the individual strip elements 5a, 5b, 5c, 5d with respect to the adjacent strip element; said position can vary from a greater inclination, which can be obtained by moving the stem 14 of the slider 12 at the wing of the opening 10 which is perpendicular to the one directed toward the rear quarter 4, to a lateral or longitudinal rotation of the front quarter 3, forcing various placements of the sliders present at the sides of each of said strip elements.

All these adjustments are facilitated by the optional presence of the cable 17 and of the knob 18, which allows to vary the degree of interaction among the individual strip elements.

It has thus been observed that the invention has achieved the intended aim and objects, a boot having been provided in which the plurality of the strip elements which constitute the front quarter is connected and can perform a controllable relative oscillation, this allowing to optimally adapt the movement of the boot to the natural movement of the leg, following said leg during the flexing and extension steps.

The individual strip elements can furthermore be adapted, independently of one another, to the specific anatomical shape of the leg, ensuring a better embracing of the leg and adaptation of the boot thereto.

Furthermore, the possibility of laterally rotating the quarter by acting at the individual strip elements allows to use the boot in the "snowboarding" method as well.

The invention is naturally susceptible to numerous modifications and variations, all of which are within the scope of the same inventive concept.

Thus, for example, FIGS. 4–11 illustrate a second embodiment of a boot 101 which is again composed of a shell 102 with which a front quarter 103 and a rear quarter 104 are associated.

In this embodiment, the front quarter 103 is constituted by three mutually independent strip elements, indicated by the numerals 105a, 105b and 105c respectively.

Said strip elements are associated in an oscillating manner with one another and with the shell 102 by means of a pair of lateral bars 121a and 121b which are transversely pivoted, at one end, to the shell 102; advantageously, a plurality of holes 122 for pivoting to the shell may be provided at the end of said lateral bars which is adjacent to the sole of the boot, so as to allow to vary the height of said lateral bars and consequently the height of the strip elements with respect to the shell.

The interconnection between the strip elements and the lateral bars occurs by means of adapted holes or by advantageously providing, laterally with respect to each strip element, adapted openings 110 which have various possible configurations, advantageously a cross-like or straight configuration.

An adapted pivot 123 is arranged at said holes or openings and allows the strip elements to oscillate with respect to the bars and to vary the inclination and/or height of each individual strip element with respect to the adjacent one.

FIGS. 5–10 illustrate the various movements which can be imparted, individually or in combination, to the bars and to the strip elements.

Figure 5:
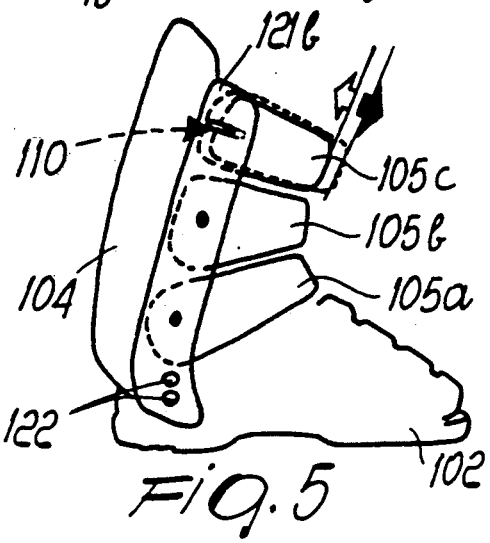
FIG. 5 is a first side view of the boot of FIG. 4.

In particular, FIG. 5 shows how it is possible to achieve an adjustment along an axis which is longitudinal to each strip element by imparting a movement of said elements with respect to the lateral bar in order to adapt to the contour of the leg.

Figure 6:
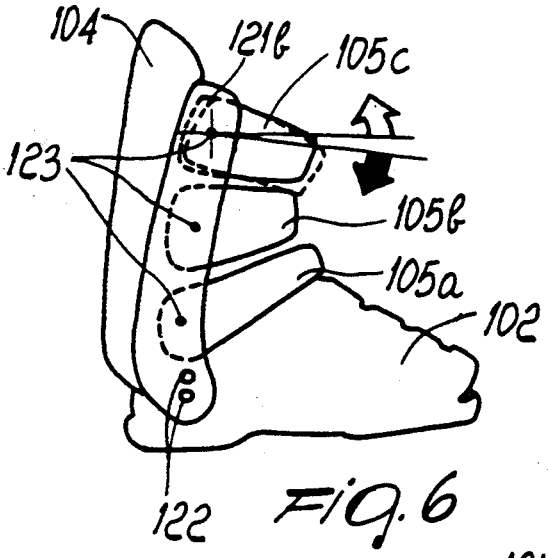
FIGS. 6, 7, 8, 9 and 10 are views, similar to the preceding one, of the various configurations which can be assumed by the boot according to the second embodiment.

FIG. 6 illustrates the possibility of imparting a rotation to one or more of the strip elements with respect to the lateral bars, which can also be rigidly fixed to the shell.

Figure 7:
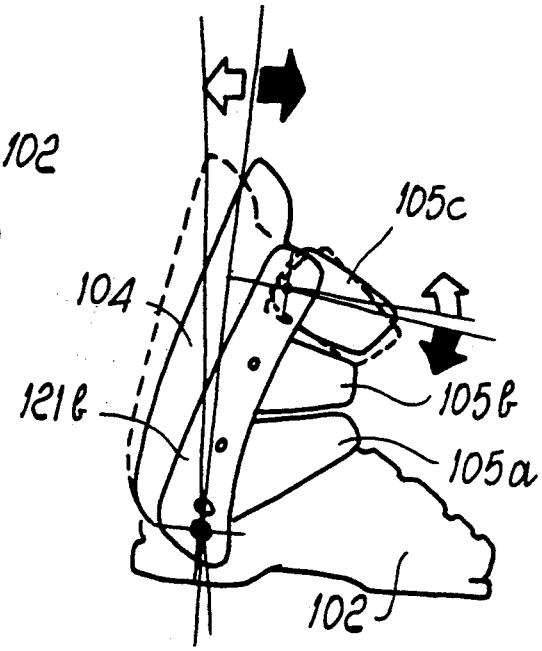

FIG. 7 illustrates the possibility of obtaining a rotation of each strip element with respect to the lateral bars and of said bars with respect to the shell.

Figure 8:
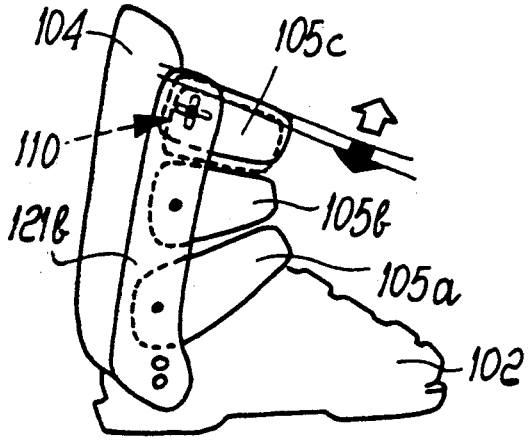

FIG. 8 illustrates a possible adjustment of the height of each strip element with respect to the lateral bars, which can be associated in a fixed manner with the shell or can be pivoted thereto.

Figure 9:
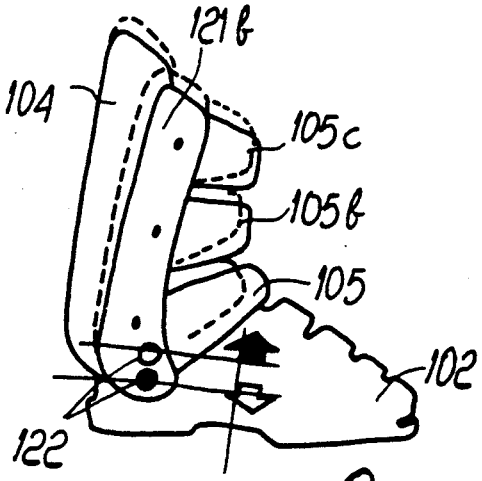
Figure 10:
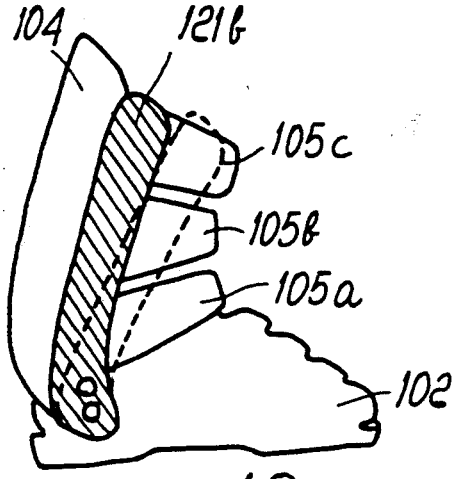

FIG. 9 illustrates a possible adjustment of the height of the entire assembly constituted by the lateral bars and by the strip elements, by virtue of the presence of the holes defined proximate to an end of said lateral bars or proximate to possible different seats defined on the shell for the pivoting of said bars.

Figure 11:
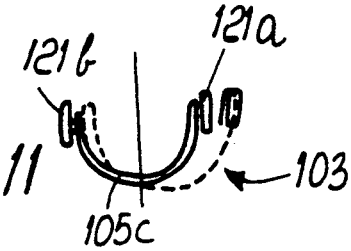
FIG. 11 is a top view of a position which can be assumed by the quarter according to the preceding figures.
Figure 12:
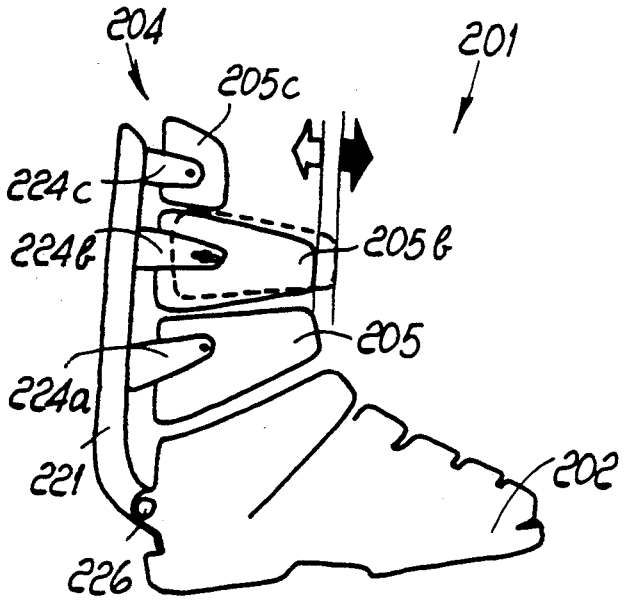
FIG. 12 is a side view of a further embodiment of the boot.
Figure 13:
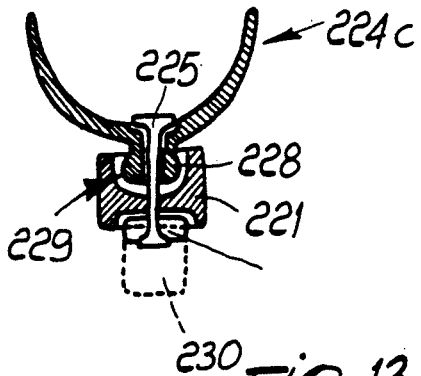
FIG. 13 is a partially sectional view of the interconnection between the bar and the wings for connection to the band-like elements.

FIG. 11 illustrates the possible positions of the front quarter by imparting a lateral oscillation to the lateral bars 121*a* and 121*b*, with simultaneous rotation of the strip elements 105*a*, 105*b* and 105*c* along a transverse axis.

FIGS. 12–16 illustrate a further embodiment, in which the boot 201 again has a shell 202 and a quarter 204 constituted by three strip elements 205*a*, 205*b* and 205*c* which are mutually independent and distinct; each of said elements is laterally associated, in an oscillating manner, with a pair of connecting wings indicated by the numerals 224*a*, 224*b* and 224*c*.

Each of said connecting wings has a curved configuration and is centrally perforated for connection, by means of a pivot 225, to a single bar 221 which is arranged longitudinally and rearward with respect to the rear quarter 204 and is in turn articulated, at one end, to the shell 202, at an adapted lug 226 or laterally to said shell, said end dividing into two arms 227.

The interconnection between the connecting wings and the strip elements can be of the type illustrated in the preceding embodiments, whereas the connection between the connecting wings and the bar 221 can again be of the oscillating type, each connecting wing having, at the pivot 225 and in the direction of the bar 221, a spherical protrusion 228 which can be accommodated in a complimentarily shaped seat 229 defined on said bar.

Advantageously, the pivot 225 can interact, at its other end, with an eccentric element 230 to vary the degree of interaction between the connecting wings and the bar.

Figure 14:
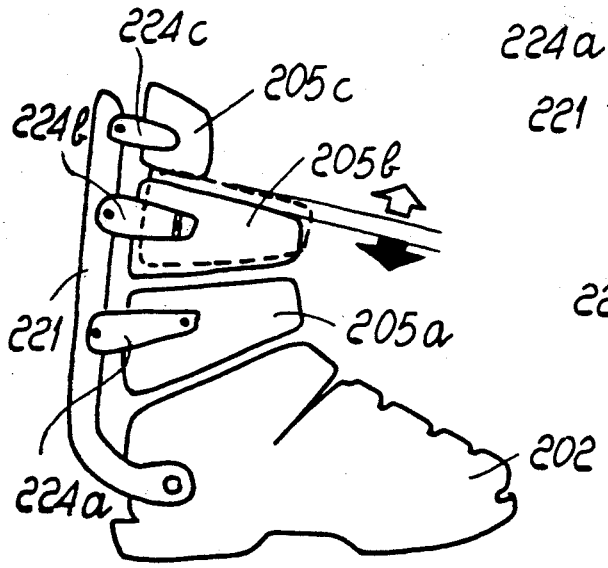
FIGS. 14 and 15 are views, similar to that of figure 12, of the various configurations which can be assumed by the boot.
Figure 15:
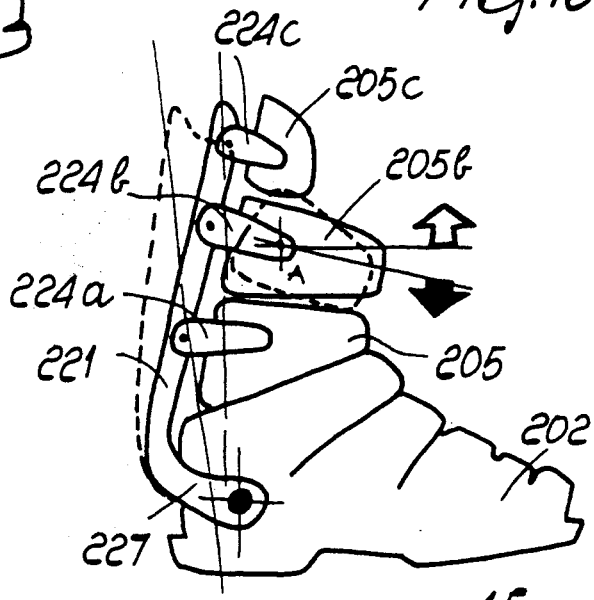

Alternatively, as illustrated in FIGS. 14 and 15, the connecting wings can be pivoted directly transversely to the bar 221.

Figure 16:
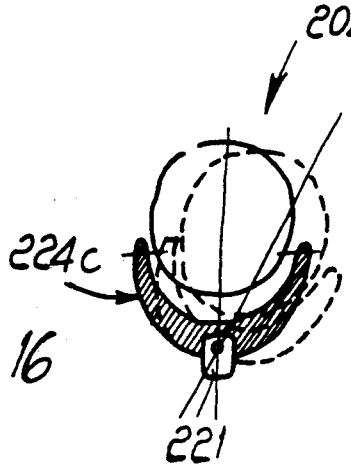
FIG. 16 is a partially sectional schematic top view of the position which can be assumed by the quarter.

FIG. 16 schematically illustrates the lateral oscillation which can be achieved by the quarter by varying the position of the connecting wings with respect to the bar and of the strip elements with respect to said wings.

Figure 17:
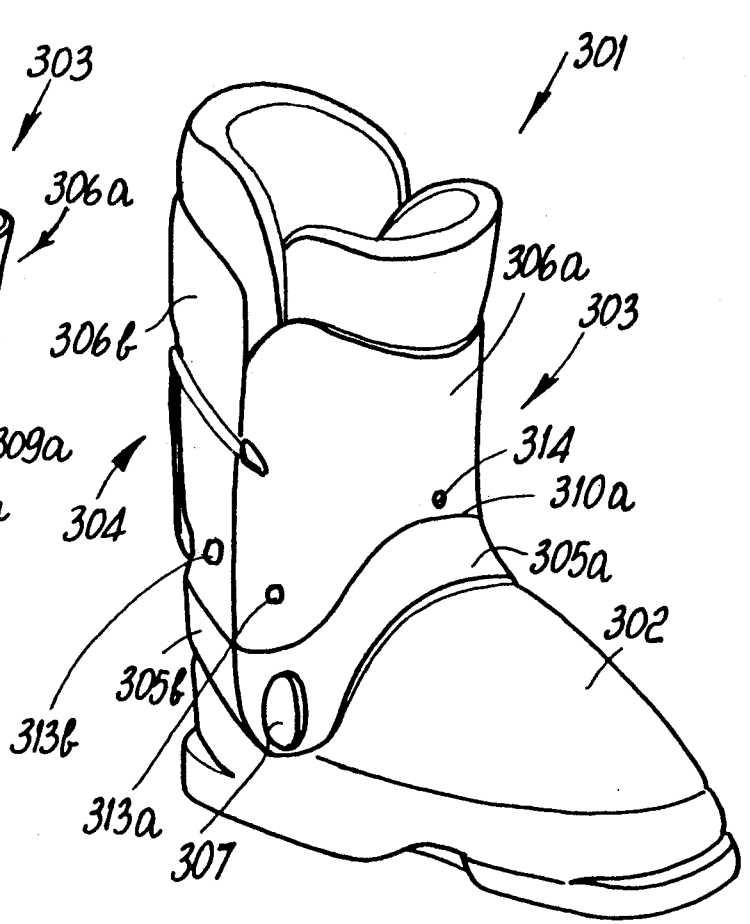
FIG. 17 is a front perspective view of a boot according to a further embodiment of the invention.
Figure 18:
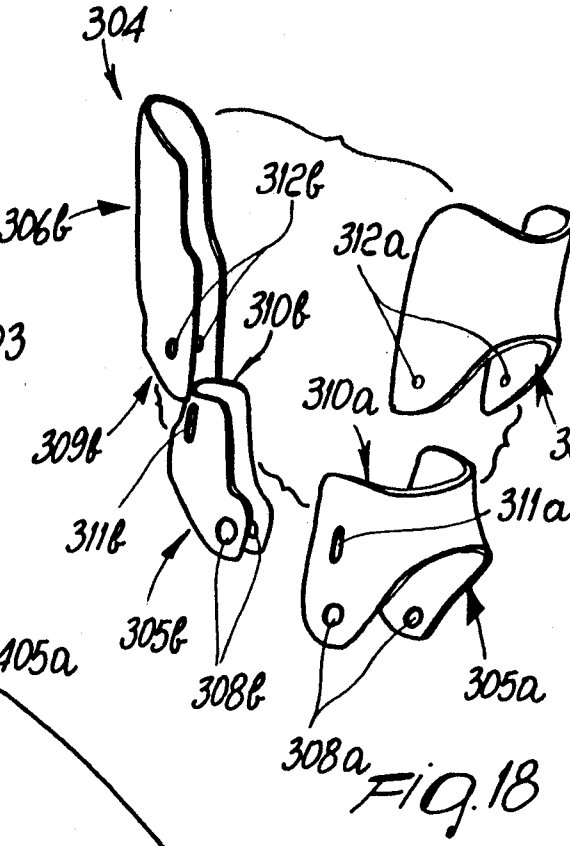
FIG. 18 is an exploded view of the component elements of the boot of FIG. 17.

With reference to FIGS. 17–18, the reference numeral 301 generally indicates a ski boot which is constituted by a shell 302, by a front quarter 303 and by a rear quarter 304.

Each of said front and rear quarters 303 and 304 is constituted by a first element and by a second element which are mutually distinct and are identified by the numerals 305*a*, 305*b* and 306*a*, 306*b* respectively. The first and second elements extend along the entire transverse extension of the quarter, and the second element is arranged above the first element with respect to the longitudinal extension of the quarter.

The first element 305*a* of the front quarter 303 is transversely pivoted, like the first element 305*b* of the rear quarter 304, at the shell 302 by first connection means comprising adapted studs 307 which pass through adapted first holes 308*a* and 308*b* defined at the lower lateral ends of the first elements 305*a* and 305*b*.

The lower ends 309*a* and 309*b* of the second elements 306*a* and 306*b* of the front quarter 303 and of the rear quarter 304 can advantageously slide and can be arranged coaxially inside the upper ends 310*a* and 310*b* of the first elements 305*a* and 305*b*.

Alternatively, said lower ends 209*a* and 309*b* can be arranged coaxially and externally with respect to the upper ends 310*a* and 310*b* of the first elements 305*a* and 305*b*.

Adapted pairs of first longitudinal slots 311*a* and 311*b* are furthermore laterally defined at said first elements 305*a* and 305*b* proximate to said upper ends 310*a* and 310*b*, and pairs of second holes 312*a* and 312*b* are defined at the lateral regions of the second elements 306*a* and 306*b* proximate to the lower ends 309*a* and 309*b*.

Once said first element and said second element are mutually associated, said pairs of first and second slots face one another so as to thus allow the connection between said first and second elements by using adapted first rivets 313*a* and 313*b* arranged at said pairs of first slots and second holes. The slots 331*a* and 331*b*, holes 312*a* and 312*b*, and rivets 313*a* and 313*b* act as a second pivotal connection means for connecting the second element to the first element in a manner such as to allow free relative pivoting movement during use of the second element with respect to the first element around an axis which is substantially parallel to the ski boot shell extension from the front to the rear end thereof, which thereby provides the lateral shape adaptation as discussed previously.

Advantageously but not necessarily, the first element 305*a* and the second element 306*a* are mutually centrally articulated by using a second rivet 314 arranged in a region in which said lower end 309*a* and said upper end 310*a* overlap.

The use of the boot therefore provides, besides a forward rotation of the quarters with respect to the shell, also a lateral sliding, along a longitudinal axis, of the second elements 306*a* and 306*b* with respect to the first elements 305*a* and 305*b*.

This allows, during the practice of sports, to achieve a lateral rotation of the quarters which is suitable for optimally following the movement of the leg, particularly during snowboarding: the combination of said rotation with the forward rotation of the quarters substantially leads to a movement of said quarters about a cone which has an axis which is approximately vertical or defines a small angle with respect to the ideal line perpendicular to the sole of the boot.

Other devices, such as longitudinal and lateral flexibility adjustment devices and devices for adjusting the degree of inclination which can be imparted to the quarters with respect to the shell, can naturally be applied to the above described structure.

By virtue of the mutual lateral sliding of the first and second elements along longitudinal axes, a dynamic variation of the configuration of the boot is achieved, and said variation resembles as closely as possible the natural rotational movement of the leg about the ankle.

Furthermore, the use of front and rear quarters constituted by individual and distinct elements can be achieved industrially in a very easy manner, and the assembly of said elements is very rapid.

Figure 20:
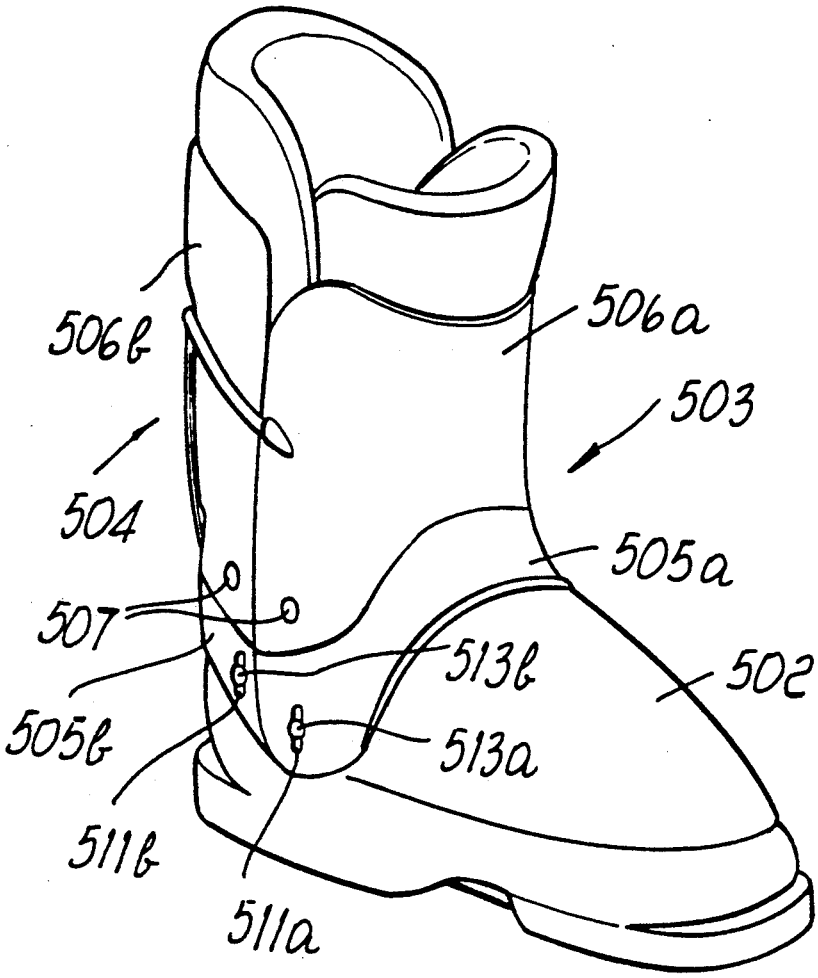
FIG. 20 is a front perspective view of a boot according to a further embodiment of the invention.
Figure 21:
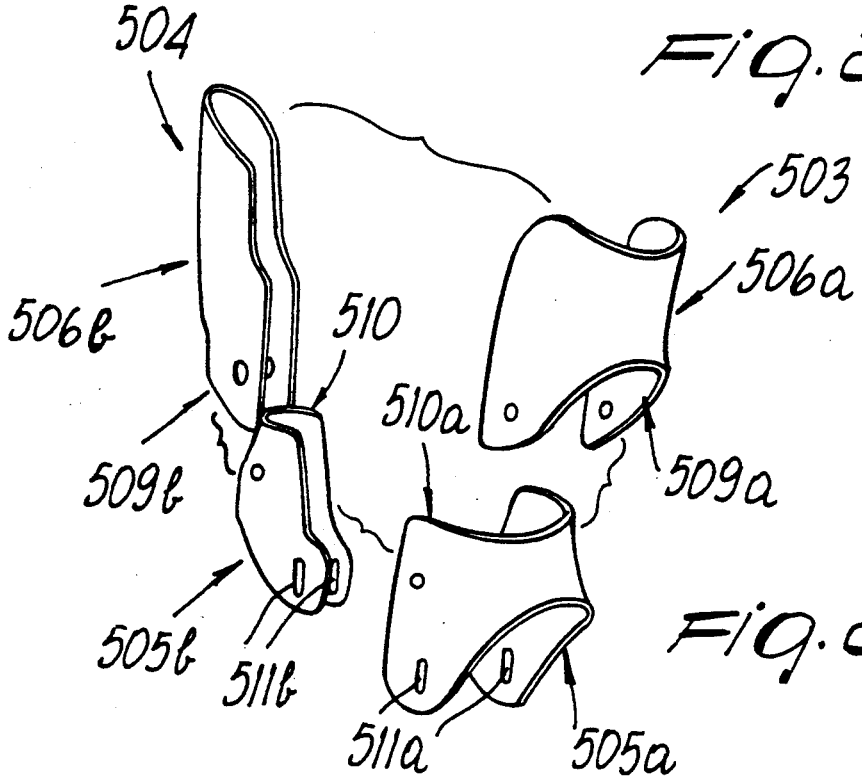
FIG. 21 is an exploded view of the component elements of the boot of FIG. 20.

As seen in FIGS. 20 and 21, alternatively the first elements 505*a* and 505*b* of said front and rear quarters B2 503 and 504 can be laterally and slidably associable with the shell 502 along an axis which is longitudinal to said quarters, said first elements having adapted first longitudinal slots 511*a* and 511*b* which can be coupled, by means of adapted first rivers 513*a* and 513*b*, to second holes defined laterally with respect to said shell, or vice versa; consequently, said second elements 506*a* and 506*b* of said front and rear quarters are provided transversely, proximate to their lower ends 509*a* and 509*b*, to the upper ends 510*a* and 510*b* of said first elements by means of adapted studs or second rivets 507.

Figure 19:
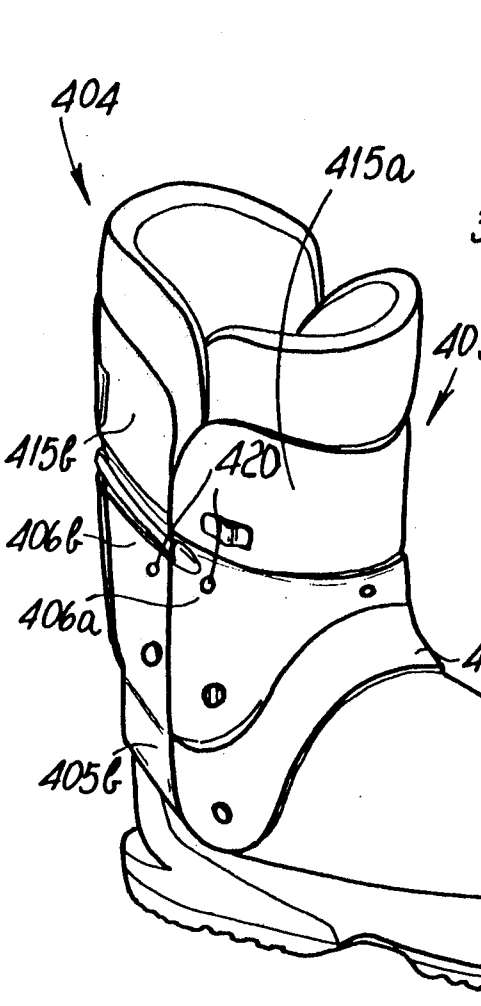
FIG. 19 is a view, similar to FIG. 17, of still a further embodiment of the boot according to the invention.

FIG. 19 illustrates a further embodiment, in which the front quarter 403 and the rear quarter 404 are constituted by a first element 405*a* and 405*b*, by a second element 406*a* and 406*b*, and by a third element 415*a* and 415*b*; said third elements are associated at the upper end of the second elements 406*a* and 406*b* by using possible adapted knows devices, such as pivots, 420 suitable for varying their inclination with respect to said second elements.

The boot according to the invention is naturally susceptible to numerous modifications and variations, all of which are within the scope of the same inventive concept.

The materials and the dimensions which constitute the individual components of the boot may naturally be the most pertinent according to the specific requirements.

We claim:

1. Ski boot, comprising a front quarter and a rear quarter and a shell, each one of said front and rear quarters comprising at least two independent strip elements which are mutually connected, wherein said ski boot further comprises means for transversely pivoting a first strip element of said strip elements to said shell, and wherein said ski boot further comprises means for laterally and slidably connecting a second strip element of said strip elements to said first strip element along an axis which is longitudinal to said quarter.

2. Ski boot according to claim 1, wherein said means for laterally and slidably connecting comprise lateral longitudinal slots provided on said first strip element and rivets rigidly connected to said second strip element and slidably accommodated in said slot.

3. Ski boot according to claim 1, wherein each of said front and rear quarters comprise a third strip element, the ski boot further comprising means for pivotally connecting said third strip element to said second strip element.

4. Ski boot, comprising a front quarter and a rear quarter and a shell, each one of said front and rear quarters comprising at least two independent strip elements which are mutually connected, wherein said ski boot further comprises means for laterally and slidably connecting a first strip element of said strip elements with said shell along an axis which is longitudinal to said quarter, and wherein said ski boot further comprises means for transversely pivoting a second strip element of said strip elements to said first strip element.

5. A ski boot comprising a shell and at least one quarter connected to said shell, said quarter having a longitudinal extension and a transverse extension, said shell having a longitudinal extension which extends from a front end to a rear end thereof, said quarter comprising at least two independent strip elements which are mutually connected, each one of said strip elements having an extension which substantially entirely extends along said transverse extension of said quarter, said strip elements being mutually arranged one above the other along said longitudinal strip elements comprising a first strip element and a second strip element, said ski boot comprising first connection means for connecting said first strip element to said shell and a second connection means for connecting said second strip element to said first strip element, t least one of said first and second connection means being a pivotal connection means for allowing a freely pivotal relative movement during use of the ski boot between said first and second strip elements or between said first strip element and said shell around an axis which is substantially parallel to said longitudinal extension of said shell the ski boot comprising a front and a rear quarter, each one of said front and rear quarters comprising respective said first and second strip elements.

6. Ski boot according to claim 5, wherein said each one of said front and rear quarters further comprises a third strip element pivotally connected to said second strip element above said second strip element along said longitudinal extension of said quarter.

* * * * *